US005349016A

United States Patent [19]

DeNicola, Jr. et al.

[11] Patent Number: 5,349,016

[45] Date of Patent: Sep. 20, 1994

[54] FIBERS OF GRAFT COPOLYMERS HAVING A PROPYLENE POLYMER MATERIAL BACKBONE

[75] Inventors: Anthony J. DeNicola, Jr.; Rosemary C. Sams, both of Newark, Del.

[73] Assignee: Himont Incorporated, Wilmington, Del.

[21] Appl. No.: 737,952

[22] Filed: Jul. 30, 1991

[51] Int. Cl.[5] ..... C08G 63/91

[52] U.S. Cl. ..... 525/71; 525/242; 525/301; 525/310; 525/312; 428/364; 428/365; 428/85

[58] Field of Search ..... 525/71, 242, 301, 310, 525/312; 428/364, 365, 85

[56] References Cited

U.S. PATENT DOCUMENTS

| | | | |
|---|---|---|---|
| 3,644,581 | 2/1972 | Knaack | 525/263 |
| 3,849,516 | 11/1974 | Plank | 525/50 |
| 4,732,571 | 3/1988 | Boocock et al. | 8/513 |
| 4,872,880 | 10/1989 | Boocock | 8/513 |
| 4,957,974 | 9/1990 | Ilenda et al. | 525/301 |

*Primary Examiner*—John Kight, III
*Assistant Examiner*—Rachel Johnson

[57] ABSTRACT

Disclosed are fibers comprising a graft copolymer consisting of a propylene polymer material backbone having graft polymerized thereto an ethylenically unsaturated monomer(s) or a blend of at least two of said graft copolymers.

20 Claims, No Drawings

FIBERS OF GRAFT COPOLYMERS HAVING A PROPYLENE POLYMER MATERIAL BACKBONE

FIELD OF THE INVENTION

This invention relates to fibers produced from graft copolymers. More particularly, it relates to fibers produced from graft copolymers having a propylene polymer material backbone. Specifically, the invention relates to fibers produced from graft copolymers having a propylene polymer material backbone graft polymerized with ethylenically unsaturated monomer(s) or blends of said graft copolymers.

BACKGROUND OF THE INVENTION

Polyolefin fibers are known in the art. Polypropylene fibers are particularly attractive because of their low density, high melting point, inertness to a wide variety of inorganic acids and bases and organic solvents at room temperature and low cost. However, polypropylene fibers, like other polyolefins, are inherently difficult to dye and very susceptible to UV and thermal degradation.

To address some of these problems, polyolefin fibers have been prepared from polyolefin compositions containing grafted polyolefins. For example, U.S. Pat. No. 3,849,516 discloses incorporating into stabilized polyolefin compositions consisting of a polyolefin and conventional stabilizing additives, from 0.5 to 1 wt. % of a grafted polyolefin, such as acrylic acid grafted polypropylene, based on the total weight of the final blend, to decrease the amount of conventional stabilizers used in the composition.

In an attempt to improve the dye affinity of polyolefin fibers, polyolefin compositions have been blended with 1 to 50 parts by weight of graft copolymer having 0.1 to 20 wt. % of at least one alpha, beta-unsaturated carboxylic acid or anhydride thereof grafted onto a preformed polyolefin backbone, as disclosed in U.S. Pat. Nos. 4,732,571 and 4,872,880. The monomers disclosed are non-homopolymerizable monomers. According to another method, fibers are prepared from a monoethylenically unsaturated, heterocyclic, nitrogen-containing monomer either alone or together with one or more other ethylenically unsaturated monomers graft polymerized onto a polyolefin backbone using a particular diperester free radical initiator. This method is described in U.S. Pat. No. 3,644,581.

U.S. Pat. No. 4,957,974 discloses blends which exhibit improved melt strength, comprising a polyolefin and a graft copolymer consisting of a non-polar polyolefin trunk and at least 80% of a monomer of a methacrylic ester and less than 20% of an acrylic or styrenic monomer, wherein from 0.2 to 10% of the total formulation (polyolefin plus graft copolymer) is a chemically grafted acrylic polymer or copolymer.

However, none provide an improvement of the mechanical properties of the propylene polymer material in fiber form.

SUMMARY OF THE INVENTION

Unexpectedly, it has been found that fibers can be produced from graft copolymers of a propylene polymer material which have higher modulus and bend recovery than conventional propylene polymer material fibers, and higher elongation in the case of drawn fibers, in spite of the presence of monomers which produce polymers that have low extensibility.

According to the present invention, there is provided fibers produced from a graft copolymer comprising a propylene polymer material backbone having graft polymerized thereto from 10 to 100 pph (parts per hundred parts propylene polymer material) of at least one ethylenically unsaturated monomer.

Another embodiment of the present invention is a fiber produced from a blend of at least two graft copolymers comprising a propylene polymer material backbone having polymerized thereto from 10 to 100 pph (parts per hundred parts propylene polymer material) of at least one ethylenically unsaturated monomer, wherein either the propylene polymer material or the ethylenically unsaturated monomer(s) or both are different.

Another embodiment of the present invention is a fiber produced from a visbroken graft copolymer comprising a propylene polymer material backbone having polymerized thereto from 10 to 100 pph (parts per hundred parts propylene polymer material) of at least one ethylenically unsaturated monomer(s).

A further embodiment of the present invention is a fiber produced from a graft copolymer comprising a propylene polymer material backbone having polymerized thereto from 10 to 100 pph (parts per hundred parts propylene polymer material) of at least one ethylenically unsaturated monomer that has been mixed with up to 80 pph of a propylene polymer material, based on the graft copolymer.

DETAILED DESCRIPTION OF THE INVENTION

Unless otherwise specified all percentages and parts are by weight in this specification.

The propylene polymer material backbone used in the present invention can be (i) a homopolymer of propylene, (ii) a random copolymer of propylene and an olefin selected from ethylene and $C_4$–$C_{10}$ alpha-olefins, provided that, when the olefin is ethylene, the maximum polymerized ethylene content is about 10%, preferably about 4%, and when the olefin content is a $C_4$–$C_{10}$ alpha-olefin, the maximum polymerized content thereof is about 20%, preferably about 16%, or (iii) a random terpolymer of propylene with two alpha-olefins selected from the group consisting of ethylene and $C_4$–$C_8$ alpha-olefins, provided that the maximum polymerized $C_4$–$C_8$ content is about 20%, preferably about 16%, and when ethylene is one of said alpha-olefins, the maximum polymerized ethylene content is about 5%, preferably about 4% with a maximum comonomer content of 25%.

The $C_4$–$C_{10}$ alpha-olefins include linear or branched $C_4$–$C_{10}$ alpha-olefins such as 1-butene, 1-pentene, 4-methyl-1-pentene, 3-methyl-1-butene, 1-hexene, 3, 4-dimethyl-1-butene, 1-heptene, 3-methyl-1-hexene and the like.

Preferred propylene polymer material backbones are polypropylene and ethylene-propylene random copolymer.

The ethylenically unsaturated monomer(s) to be grafted onto the propylene polymer material backbone can be (i) an aromatic vinyl compound selected from the group consisting of styrene, an alkyl or alkoxy ring-substituted styrene where the alkyl or alkoxy is a $C_{1-4}$ linear or branched alkyl or alkoxy, such as p-methoxystyrene and p-methylstyrene, mixtures thereof wherein the alkyl or alkoxy ring-substituted styrene is present in an amount of from 5 to 95%, or mixtures of styrene or an alkyl or alkoxy ring-substituted styrene with 5 to 40% of alpha-methylstyrene or alpha-methylstyrene derivatives; (ii) an acrylic compound selected from the group consisting of methyl acrylate, ethyl acrylate, n-propyl acrylate, n-butyl acrylate, methyl methacrylate, ethyl methacrylate, n-propyl methacrylate, phenyl methacrylate, benzyl methacrylate, o-methoxyphenyl methacrylate, 2-methoxy ethyl acrylate, 2-ethoxy ethyl acrylate, 2-hydroxyethyl methacrylate, 3-methoxy propyl acrylate, 3-ethoxy propyl acrylate, 2-ethyl hexyl acrylate, acrylonitrile, methacrylonitrile, acrylic acid, methacrylic acid and mixtures thereof; or (iii) mixtures of (i) and (ii) in amounts of from 0.5:99.5 to 99.5:0.5.

Preferred grafting monomers are styrene, methyl methacrylate, styrene and alpha-methylstyrene, styrene and methyl methacrylate and styrene and methacrylic acid.

Suitable particulate forms of the grafted propylene polymer material include powder, flake, granulate, spherical, cubic and the like. Spherical particulate forms prepared from a propylene polymer material having a pore volume fraction of at least about 0.07 are preferred.

Most preferred for preparing the grafted propylene polymer material is a propylene polymer material having (1) a weight average diameter of about 0.4 to 7 mm, (2) a surface area of at least 0.1 $m^2/g$, and (3) a pore volume fraction of at least about 0.07 wherein more than 40% of the pores in the particle have a diameter larger than 1 micron. Such propylene polymer materials are commercially available from HIMONT Italia S.r.l.

The grafted propylene polymer material of the present invention is prepared by the free radical initiated graft polymerization of at least one monomer as set forth above, at free radical sites on the propylene polymer material. The free radical sites may be produced by irradiation or by a free radical generating chemical material, e.g., by reaction with a suitable organic peroxide.

According to the method where the free radical sites are produced by irradiation, the propylene polymer material, preferably in particulate form, is irradiated at a temperature in the range of about 10° to 85° C. with high energy ionizing radiation to produce free radical sites in the propylene polymer material. The irradiated propylene polymer material, while being maintained in a substantially non-oxidizing atmosphere, e.g., under inert gas, is then treated at a temperature up to about 100° C. for a period of at least about 3 minutes, with about from 5 to 240 pph (parts per hundred parts propylene polymer material) of the particular grafting monomer or monomers used, based on the total weight of propylene polymer material and grafting monomer(s). After the propylene polymer material has been exposed to the monomer for the selected period of time, simultaneously or successively in optional order, the resultant grafted propylene polymer material, while still maintained in a substantially non-oxidizing environment, is treated to deactivated substantially all of the residual free radicals therein, and any unreacted grafting monomer is removed from said material.

The free radical deactivation of the resulting graft copolymer is conducted preferably by heating, although it can be accomplished by the use of an additive, e.g., methyl-mercaptan, that functions as a free radical trap. Typically the deactivation temperature will be at least 110° C., preferably at least 120° C. While temperatures as high as about 250° C. can be used, it is preferred to select a deactivation temperature which is below the melting point of the graft copolymer, generally a maximum of about 150° C. for graft copolymers of polypropylene. Hence, the preferred deactivation temperature is from about 120° to 150° C. for graft copolymers of polypropylene. Heating at the deactivation temperature for at least 20 minutes is generally sufficient.

Any unreacted grafting monomer is removed from the graft copolymer, either before or after the radical deactivation, or at the same time as deactivation. If the removal is effected before or during deactivation, a substantially non-oxidizing environment is maintained.

The expression "substantially non-oxidizing", when used herein to describe the environment or atmosphere to which the olefin polymer material is exposed, means an environment in which the active-oxygen concentration, i.e., the concentration of oxygen in a form that will react with the free radicals in the polymer material, is less than about 15%, preferably less than about 5%, and most preferably less than about 1%, by volume. The most preferred concentration of active oxygen is 0.004% or lower by volume. Within these limits, the non-oxidizing atmosphere can be any gas, or mixture of gases, which is oxidatively inert toward the free radicals in the olefin polymer material, e.g., nitrogen, argon, helium, and carbon dioxide.

In the method where the free radical sites are produced by an organic chemical compound, the organic chemical compound, preferably an organic peroxide, is a free radical polymerization initiator which has a decomposition half-life of about 1 to 240 minutes at the temperature employed during the treatment. Suitable organic peroxides include acyl peroxides, such as benzoyl and dibenzoyl peroxides; dialkyl and aralkyl peroxides, such as di-tert-butyl peroxide, dicumyl peroxide, cumyl butyl peroxide, 1,1-di-tert-butylperoxide-3,5,5-trimethylcyclohexane, 2,5-dimethyl-2,5-dimethyl-2,5-di-tert-butylperoxyhexane, and bis(alpha-tert-butylperoxyisopropylbenzene); peroxy esters, such as tert-butylperoxypivalate, tert-butylperbenzoate, 2,5-dimethylhexyl-2,5-di-perbenzoate, tert-butyl-di-perphthalate, tert-butylperoxy-2-ethyl hexanoate; and 1,1-dimethyl-3-hydroxybutylperoxy-2-ethyl hexanoate; and peroxy carbonates, such as di-(2-ethylhexyl)peroxy dicarbonate, di(n-propyl)peroxy dicarbonate; and di-(4-tert-butylcyclohexyl)peroxy dicarbonate. The peroxides can be used neat or in a diluent medium, having an active concentration of from 0.1 to 6.0 pph, preferably from 0.2 to 3.0 pph.

According to this method, the propylene polymer material, preferably in particulate form, at a temperature of from about 60° to 125° C. is treated with from 0.1 to 6.0 pph of a free radical polymerization initiator described above. The polymer material is treated with about 5 to 240 pph of a grafting monomer at a rate of addition that does not exceed 4.5 pph per minute at all addition levels of 5 to 240 pph of the monomer, over a period of time which coincides with, or follow, the period of treatment with the initiator. In other words, the monomer and initiator may be added to the heated propylene polymer material at the same time or the monomer may added 1) after the addition of the initiator has been completed, 2) after addition of the initiator has started but has not yet been completed, or 3) after a delay time or hold time subsequent to the completion of the initiator addition.

After the propylene polymer material has been grafted, the resultant grafted propylene polymer material, while still maintained in a substantially non-oxidizing environment, is treated, preferably by heating at a temperature of at least 120° C. for at least 20 minutes, to decompose any unreacted initiator and deactivate residual free radicals therein. Any unreacted grafting monomer is removed from said material, either before or after the radical deactivation, or at the same time as deactivation.

The grafted propylene polymer material has from 10 to 100 pph (parts per hundred parts propylene polymer material) of the monomer grafted or graft polymerized thereto, preferably 20 to 85 pph, and most preferably 20 to 55 pph.

The graft copolymer(s) are formed into fibers by conventional spinning techniques. The pelletized graft copolymer(s) is melt spun and the fibers can be stretched to orient the molecules.

When the fibers are formed from a blend of two graft copolymers of the present invention, each graft copolymer is prepared according to the grafting procedure described above, blended together to form a homogeneous blend, extruded and then pelletized. The pelletized blend is then melt spun to form fibers. The ratio of the components of the blend is from 5:95 to 95:5, preferably 20:80 to 80:20, and most preferably 50:50.

In the case where the fiber is of a visbroken graft copolymer of the invention, the graft copolymer and peroxide, from 0.05 to 3 wt. % based on the total weight of the graft copolymer, are extruded and then pelletized. The pelletized visbroken graft copolymer is then melt spun into fibers.

The term "visbroken graft copolymer" when used herein to describe a modified graft copolymer, means a graft copolymer whose melt flow rate has been increased from about 0.1 to 100 dg/min. in a controlled manner to produce a melt flow rate of from about 10 to 1000 dg/min., preferably from 10 to 100 dg/min., by using peroxide thermal degradation, radiation or other known methods used in the art. Preferably, the peroxide method is used herein.

The graft copolymer can be mixed with up to 80 pph, preferably from 5 to 50 pph, of a propylene polymer material based on the graft copolymer. The graft copolymer of the invention and the propylene polymer material are mixed to form a homogeneous blend, extruded and then pelletized. The pellets are then melt spun into fibers. The propylene polymer material blended can be the same as or different from the propylene polymer material backbone of the graft copolymer.

Conventional additives in amounts of up to 80 pph, based on 100 parts of the graft copolymer, may be blended with the graft copolymer(s) of the invention. Such additives include stabilizers, antoxidants, flame retardants and anti-slip agents.

The graft copolymer fibers of the invention may be used for, among other things, yarn materials carpet face yarns produced from staple or bulk continuous filament yarn, geotextile materials, woven an non-woven textile materials and articles produced from said materials. Blends of the graft copolymer fibers of this invention with other fibers, such as fibers prepared from nylon, polyesters, polypropylene, copolymers of propylene with other olefins which other olefins are typically present in an amount up to about 10% by wt., and acrylics, in an amount from 1 to 99% by wt., preferably 5 to 75% by wt. and most preferably from 5 to 50% by wt., are within the broadest ambit of this invention.

In the examples which follow, the graft copolymer fibers were tested according to the procedures which are set forth below.

The melt flow rate (MFR) of the graft copolymers was determined by ASTM method D-1238, Procedure B, Condition L.

The fibers of the graft copolymers of the present invention and controls in Tables 1 and 2 were melt spun on a small scale fiber line having a ¾" single screw Killion extruder with a 24:1 L/D ratio, a melt pump, a 7 hole die and godet (metal rolls at room temperature) under the following conditions:

| | |
|---|---|
| Melt temperature | 225° C.-250° C. |
| Output rate | 3.5 g/min (0.5 g/min per hole for the 7 hole die) |
| Air quenched | carried out at room temperature |
| Uptake rate | 500 mpm |

Prior to any physical testing all fibers were conditioned for at least 40 hours at a relative humidity of from 30 to 38% and a temperature of from 21°to 22° C.

An Instron Model 1122 tester with pneumatic action grips was used to obtain elongation, secant modulus and tenacity. The testing conditions were as follows: 50 mm/min crosshead speed, 100 mm/min chart speed, 25.4 mm span and load cell of 500 grams.

$$\text{Elongation} = \frac{\text{chart distance} \times 100}{\text{span} \times MR}$$

$$\text{where, } MR = \frac{\text{chart speed}}{\text{crosshead speed}}$$

$$\text{Secant Modulus} = \frac{\text{load at 5\%}}{\text{denier} \times (0.05)}$$

$$\text{Tenacity} = \frac{\text{max. load on fiber}}{\text{denier}}$$

The bend recovery was determined by the Mandrel Method. A weight is attached to one end of a filament (5 g for an undrawn filament and 2 g for a drawn filament), and the other end of the filament is inserted in one of the holes in a 0.093" diameter mandrel. The filament and weight hang freely in the support and 10 or more loops are wrapped around the mandrel. The weight is cut off and the loose end of the filament is fastened in a different hole in the mandrel; the number of loops are counted and allowed to stand for 4 minutes. The filament is cut off the mandrel, by cutting the filament at each hole, and placed in water at 23° C. The filament is allowed to relax for 1 hour and the number of remaining loops are counted. The calculation for the % bend recovery is as follows:

$$\text{\% Bend recovery} = \frac{\text{Initial no. of loops} - \text{No. of loops after relaxing}}{\text{Initial No. of loops}} \times 100$$

The present invention will be illustrated in greater detail with reference to the examples of the invention set forth below.

EXAMPLE 1

997.9 kg Valtec 7026XOS propylene homopolymer was placed into a 6300 liter steel reactor equipped with a heating jacket and a ploughshare type agitator. The polymer was in the form of generally spherical particles with a MFR of 28.8 dg/min.

Vacuum was pulled on the reactor three separate times, each time returning to atmospheric pressure with nitrogen, then the reactor was heated to 110° C. by circulating hot oil through the reactor jacket, and equilibrated at that temperature while stirring at 115 rpm.

332 kg styrene at 0.91 pph/min. and 18.8 kg mineral spirit solution of tert-butylperoxy-2-ethylhexanoate (50% by weight of mineral spirit) at 0.052 pph/min. were fed co-continuously over a 36.6 minute feed time, while maintaining the temperature of the reactor contents at 110° C.

At the end of the reaction period, the reactor was purged with nitrogen for 180 minutes, and the reactor contents were heated to 135° C. with the heated nitrogen during which time any unreacted styrene monomer was swept out of the reactor in the nitrogen flow. After cool-down under a nitrogen blanket, the free-flowing solid product remaining in the reactor was discharged therefrom. A graft copolymer of a polystyrene grafted on a polypropylene backbone was obtained having a MFR of 18 dg/min. Monomer conversion to polymer was greater than 90%, based on mass balance.

The grafted copolymer obtained above and a stabilizing package consisting of 0.07 pph calcium stearate and 0.20 pph Irganox B-501W stabilizer were blended in a Henschel mill until a homogeneous blend was obtained. The blend was extruded on a Leistritz twin screw extruder and pelletized. The pelletized polypropylene-g-polystyrene copolymer was then melt spun into fibers according to the method described above at a melt spin temperature of 240° C. and conditioned at 32% relative humidity (R.H.) at 22° C. The physical properties of a single filament are set forth below in Table 1.

EXAMPLE 2

The procedure and ingredients of Example 1 were used except that 537.3 kg styrene and 30.4 kg mineral spirit solution of tert-butylperoxy-2-ethylhexanoate (50% by weight of mineral spirit) were added to the reactor, the total feed time was 59.2 minutes and the reaction temperature was 100° C. The MFR of the final graft copolymer of styrene on a polypropylene backbone was 13 dg/min. The monomer conversion was greater than 90%, based on mass balance. The melt spinning temperature was 240° C. The physical properties of a single filament are set forth below in Table 1.

EXAMPLE 3

The procedure and ingredients of Example 1 were used except that the reaction temperature was 100° C. The MFR of the graft copolymer of styrene on a polypropylene backbone was 20 dg/min. The monomer conversion was greater than 90%, based on mass balance. The melt spinning temperature was 240° C. The physical properties of a single filament are set forth below in Table 1.

EXAMPLE 4

The procedure and ingredients of Example 1 were used except that the reaction temperature was 100° C., 46.7 kg mineral spirit solution of tert-butylperoxy-2-ethylhexanoate (50% by weight of mineral spirit) at 0.052 pph/min and 816.5 kg styrene at 0.91 pph/min were fed co-continuously for 89.9 minutes. The MFR of the graft copolymer of styrene on a polypropylene backbone was 9.3 dg/min. Monomer conversion was greater than 90%, based on mass balance. The melt spinning temperature was 240° C. The physical properties of a single filament are set forth below in Table 1.

TABLE 1

| | PP* | Ex. 1 | Ex. 2 | Ex. 3 | Ex. 4 |
|---|---|---|---|---|---|
| Denier, g/9000 m | 16.8 | 19.5 | 14.4 | 10.2 | 12.9 |
| Bend Recovery, % | 53 | 67 | 63 | 60 | 77 |
| Tenacity, g/denier | 1.4 | 0.62 | 0.64 | 0.93 | 0.61 |
| 5% Secant Modulus, g/denier | 3.9 | 6.1 | 6.5 | 8.4 | 7.8 |
| Elongation, % | 609 | 661 | 498 | 474 | 335 |

*Pro-fax PF-301 fiber grade propylene homopolymer having a MFR of 35 dg/min.

As demonstrated above the graft copolymers of the invention, Examples 1 thru 4, exhibited high bend recovery and modulus as compared to the unmodified polypropylene.

EXAMPLE 5

2722 g Pro-fax SA-849 ethylene-propylene random copolymer having an ethylene content of about 4% were placed into a 8 liter steel reactor equipped with a heating jacket and an helical impeller. The polymer was in the form of generally spherical particles having a melt flow rate of 11 dg/min.

The reactor was purged with nitrogen at room temperature with stirring at 124 rpm, until the active oxygen content was less than 10 ppm (approximately 30 minutes). The contents of the reactor were then heated to 100° C. by circulating hot oil through the reactor jacket and equilibrated to that temperature while nitrogen purging and stirring continued. Thereafter, purging was stopped and the reactor pressure was adjusted to 2 psi.

907.2 g styrene and 54.94 g of mineral spirit solution of tert-butylperoxy-2-ethylhexanoate (50% by weight of mineral spirits) were added to a glass holding vessel and purged with nitrogen. The styrene monomer and peroxide solution was fed to the reactor contents at a rate of 0.55 pph (parts per 100 parts polypropylene, by weight) per minute while maintaining the temperature of the reactor contents at 100° C. The total addition time was 60 minutes. The reactor was maintained at 100° C. with stirring for an additional 30 minutes following complete addition of the monomer. At the end of the grafting period, a vacuum was drawn on the reactor contents and the temperature increased to 120° C. and held for 30 minutes. Then the vacuum was broken with nitrogen and the contents purged with nitrogen for 30 minutes. After cool-down under a nitrogen blanket, the free-flowing solid product remaining in the reactor was discharged therefrom. Obtained was a graft copolymer of styrene on an ethylene-propylene random copolymer backbone having a MFR of 9.3 dg/min. and a monomer conversion to polymer of 93%, based on mass balance.

The grafted copolymer obtained above and a stabilizing package consisting of 0.07 pph calcium stearate and 0.2 pph Irganox B-501W stabilizer were blended in a Henschel mill until a homogeneous blend was obtained. The blend was extruded at 239° C. in a Leistritz twin screw extruder at 150 rpm and then pelletized. The pelletized grafted copolymer was then melt spun into fibers according to the method described above at a melt spinning temperature of 230° C. and conditioned at 38% R.H. at 21° C. The fibers had a styrene content of 31 pph, based on the propylene polymer material.

The physical properties of a single filament are set forth in Table 2 below.

EXAMPLE 6

The procedure and ingredients of Example 5 were used except that the reactor was purged with nitrogen at room temperature with stirring at 174 rpm, until the active oxygen content was 10 ppm. 2722 g of a finely divided porous propylene homopolymer having a melt flow rate of 40 dg/min. was placed into the 8 liter reactor. 653.2 g styrene, 254 g methyl methacrylate and 52.96 g mineral spirit solution of tert-butylperoxy-2-ethylhexanoate (50% by weight of mineral spirit) were added to the holding glass. Total addition time was 60 minutes for an addition rate of 0.55 pph/min. At the end of the grafting period, a vacuum was drawn on the reactor contents and the temperature was increased to 140° C. and held for 30 minutes. The graft copolymer of styrene and methyl methacrylate copolymer on a polypropylene backbone had a MFR of 28 dg/min. and a monomer conversion to polymer of 90%, based on mass balance. The melt spinning temperature was 250° C. The total styrene and methyl methacrylate content was 30 pph, based on the propylene polymer material. The physical properties are set forth below in Table 2.

EXAMPLE 7

A fiber containing a blend of a graft copolymer of methyl methacrylate on a polypropylene backbone and a graft copolymer of styrene on a polypropylene backbone was prepared as described below.

The graft copolymer of methyl methacrylate on a polypropylene backbone was prepared according to the method of Example 5 with the following exceptions: stirring occurred at 151 rpm during nitrogen purging before the reaction, 934.4 g methyl methacrylate and 52.96 g mineral spirit tert-butylperoxy-2-ethylhexanoate (50% by weight of mineral spirit) were added to the glass holding vessel. The total addition time of the monomer and peroxide solution was 42 minutes at a rate of 0.8 pph (parts per 100 parts polypropylene, by weight) per minute. At the end of the grafting period, a vacuum was drawn on the reactor contents and the temperature was increased to 140° C. and held for 30 minutes. The methyl methacrylate content was 30 pph, based on the propylene polymer material.

The graft copolymer of styrene on a polypropylene backbone was prepared according to the method of Example 1 except that the reaction temperature was 100° C.

681 g (50:50 ratio) of each of the above prepared grafted copolymers were tumble blended in a Henschel mill until a homogeneous blend was obtained. The blend was then charged to a Leistritz twin screw extruder and extruded at a temperature of 236° C., at 150 rpm, and then pelletized. The MFR of the blend was 20.8 dg/min.

The pelletized blend was melt spun into fibers according to the method described above at a melt spinning temperature of 230° C. The physical properties of a single filament are set forth below in Table 2.

EXAMPLE 8

The procedure and ingredients of Example 5 was used except that the stirring occurred at 173 rpm during the nitrogen purging before the reaction. 834.6 g styrene, 72.6 g methacrylic acid and 55.02 g mineral spirit solution of tert-butylperoxy-2-ethylhexanoate (50% by weight of mineral spirit) were added to the holding vessel and the total addition time was 44.5 minutes for an addition rate of 0.75 pph (parts per 100 parts polypropylene, by weight) per minute. At the end of the grafting period, the vacuum was drawn on the reactor contents and the temperature was increased to 140° C. and held for 30 minutes. A graft copolymer of styrene and methacrylic acid on a polypropylene backbone was obtained having a MFR of 27.8 dg/min. Conversion of the monomers to polymers was 93%, based on mass balance.

The melt spinning temperature was 250° C. The total styrene and methacrylic acid content was 31 pph, based on the propylene polymer material. The physical properties of a single filament are set forth below in Table 2.

EXAMPLE 9

In this example, 900 g of the graft copolymer of styrene on a polypropylene backbone of Example 2, without any stabilizing package, and 0.38 g Lupersol 101 organic peroxide (0.042% peroxide based on the total weight of the graft copolymer) were charged to a Leistritz twin screw extruder, extruded at a melt temperature of 242° C., at 150 rpm, and then pelletized. The graft copolymer had a MFR of 25 dg/min.

The pelletized visbroken graft copolymer was then melt spun into fibers according to the general method described above at a melt temperature of 230° C. The physical properties of a single filament are set forth below in Table 2.

EXAMPLE 10

2724 g finely divided porous propylene homopolymer were placed in an 8 liter steel reactor equipped with a heating jacket and a helical impeller. The polymer was in the form of generally spherical particles having a MFR of 30 dg/min, commercially available from HIMONT Italia S.r.l.

The reactor was purged with nitrogen at room temperature until the active oxygen content was less than 17 rpm. The contents of the reactor was than heated to 100° C. by circulating hot oil through the reactor jacket, and equilibrated to that temperature while nitrogen purging and stirring continued at 167 rpm. Thereafter, purging was stopped.

890 g methyl methacrylate, 15 g butyl acrylate and 54.6 g mineral spirit solution of tert-butylperoxy-2-ethylhexanoate (50% by weight of mineral spirit) were added to the glass holding vessel and purged with nitrogen. The monomer and peroxide solution was fed to the reactor contents at a rate of 1.1 pph (parts per 100 parts polypropylene) per minute while maintaining the temperature of the reactor contents at 100° C. The total addition time was 30.8 minutes. The reactor was maintained at 100° C. with stirring for an additional 30 minutes following complete addition of the monomer. At the end of the grafting period, a vacuum was drawn on the reactor contents and the temperature increased to 140° C. The temperature was maintained at 140° C. for 20 minutes, then the vacuum was broken with nitrogen and the contents purged with nitrogen. After cool down under a nitrogen blanket, the free-flowing solid product remaining in the reactor was discharged and weighed. Obtained was a graft copolymer of methyl methacrylate on a polypropylene backbone having a monomer conversion of 100% and a MFR of 23 dg/min.

The graft copolymer obtained above and 0.05 pph Irganox 1010 stabilizer were blended in a Henschel mill until a homogeneous blend was obtained. The blend was extruded at 258° C. in a Haake single screw extruder at 150 rpm and pelletized. The pelletized graft copolymer was then melt spun into fibers according to the general method described above at a melt temperature of 227° C. The fibers had a methyl methacrylate content of 33 pph based on the propylene polymer material and were conditioned at 30% R.H. at 22° C. The physical properties of a single filament are set forth below in Table 2.

TABLE 2

| | Ex. 5 | EX. 6 | Ex. 7 | Ex. 8 | Ex. 9 | Ex. 10 |
|---|---|---|---|---|---|---|
| Denier, g/9000 m | 17.8 | 9.5 | 9.6 | 7.6 | 10.1 | 20.3 |
| Bend Recovery, % | 63 | 60 | 73 | 67 | 63 | 70 |
| Tenacity, g/denier | 0.6 | 1.04 | 1.0 | 1.3 | 0.8 | 0.7 |
| 5% Secant Modulus, g/denier | 4.0 | 9.0 | 9.8 | 11.3 | 7.1 | 7.1 |
| Elongation, % | 567 | 584 | 565 | 560 | 522 | 616 |

EXAMPLES 11 AND 12

This example illustrates undrawn continuous multifilaments prepared from the graft copolymers of the invention. The multifilaments were spun from the control Pro-fax 6323 propylene homopolymer having a MFR of 12 dg/min. Example 11 is the graft copolymer of styrene on a polypropylene backbone of Example 2 and Example 12 is the graft copolymer of styrene and methacrylic acid on a polypropylene backbone of Example 8.

The undrawn continuous multifilaments were produced on a pilot size fiber line (Hills R&D, Inc., Melbourne, Fla.), having a 1¼" single screw extruder with a 30:1 L/D ratio, a Maddock mixing section, melt pump, 126 Delta filament die, feed roll and winder. The melt temperature was 253° to 260° C., and the roll speed was 400 m/min. The physical properties of the 126 filament bundle are set forth below in Table 3.

TABLE 3

| | Control | Ex. 11 | Ex. 12 |
|---|---|---|---|
| Denier, g/9000 m | 3120 | 4170 | 3160 |
| 5% Secant Mod., g/denier | 6.6 | 8.47 | 8.29 |
| Elongation, % | 801 | 1302 | 1216 |

The undrawn multifilament fiber of the invention, Examples 11 and 12 demonstrate higher modulus and elongation than the polypropylene control.

EXAMPLE 13 AND 14

This example illustrates 2 ply drawn, twisted continuous multifilaments having a draw ratio of 3:1 and 252 filaments prepared from the graft copolymers of the invention. Example 13 is the graft copolymer of Example 11, Example 14 is the graft copolymer of Example 12 and the Control is the Pro-fax 6323 propylene homopolymer with a MFR of 12 dg/min.

The yarn was prepared according to the procedure of Examples 11 and 12, except that the multifilaments were drawn, bulked, air tacked and wound in a second process step. The feed roll temperature was 100° C. and the speed was 400 m/min. The draw roll temperature was 130° C. with a speed of 1200 m/min. The physical properties are set forth below in Table 4.

TABLE 4

| | Control | Ex. 13 | Ex. 14 |
|---|---|---|---|
| Denier, g/9000 m | 2600 | 2600 | 2600 |
| 5% Secant Mod., g/denier | 8.37 | 9.31 | 9.08 |
| Elongation, % | 134 | 201 | 265 |

Examples 13 and 14 demonstrate that the multifilament yarns of the present invention have higher modulus and elongation than the polypropylene multifilament Control.

Other features, advantages and embodiments of the invention disclosed herein will be readily apparent to those exercising ordinary skill after reading the foregoing disclosures. In this regard, while specific embodiments of the invention have been described in considerable detail, variations and modifications of these embodiments can be effected without departing from the spirit and scope of the invention as described and claimed.

We claim:

1. A fiber consisting essentially of a graft copolymer consisting of a propylene polymer material backbone having graft polymerized thereto 20 to 85 parts per hundred part propylene polymer material of at least one ethylenically unsaturated monomer or a blend of at least two of said graft copolymers, wherein either the backbone or monomer(s) or both are different.

2. The fiber of claim 1, wherein the propylene polymer material backbone is selected from the group consisting of a homopolymer of propylene, a random copolymer of propylene and an alpha-olefin selected from ethylene and $C_4$–$C_{10}$ alpha-olefins, and a random terpolymer of propylene with two alpha-olefins selected from ethylene and $C_4$–$C_8$ alpha-olefins.

3. The fiber of claim 1, wherein the ethylenically unsaturated monomer is selected from the group consisting of an aromatic vinyl compound, an acrylic compound and mixtures thereof.

4. The fiber of claim 3, wherein the vinyl compound is selected from the group consisting of styrene, a $C_1$–$C_4$ linear or branched alkyl or alkoxy ring substituted styrene, mixtures thereof, and mixtures of styrene or said alkyl or alkoxy ring substituted styrene with 5 to 40% of alpha-methylstyrene or alpha-methylstyrene derivatives.

5. The fiber of claim 3, wherein the acrylic compound is selected from the group consisting of n-butyl acrylate, methyl methacrylate, butyl methacrylate, acrylic acid, methacrylic acid, acrylonitrile and methacrylonitrile.

6. The fiber of claim 3, wherein said monomers are selected from the group consisting of styrene, methyl methacrylate, a combination of styrene and methyl methacrylate and a combination of styrene and methacrylic acid.

7. The fiber of claim 1, wherein the monomer is present in an amount of from 20 to 55 pph.

8. The fiber of claim 7, wherein the graft copolymer is styrene on a polypropylene backbone.

9. The fiber of claim 7, wherein the graft copolymer is methyl methacrylate on a polypropylene backbone.

10. The fiber of claim 7, wherein the graft copolymer is styrene and alpha-methylstyrene on a ethylene-propylene random copolymer backbone.

11. The fiber of claim 7, wherein the graft copolymer is styrene and methyl methacrylate on a polypropylene backbone.

12. The fiber of claim 7, wherein the graft copolymer is styrene and methacrylic acid on a polypropylene backbone.

13. The fiber of claim 1, wherein said graft copolymer has been visbroken.

14. The fiber of claim 1, wherein said graft copolymer is blended with up to 80 pph of a propylene polymer material selected from the group consisting of (i) a homopolymer of propylene, (ii) a random copolymer of propylene and an alpha-olefin selected from the group consisting of ethylene and $C_4$–$C_{10}$ alpha-olefins and (iii) a random terpolymer of propylene with two alpha-olefins selected from the group consisting of ethylene and $C_4$–$C_8$ alpha-olefins.

15. The fiber of claim 1, wherein the blend of said graft copolymers comprises two graft copolymers having different ethylenically unsaturated monomers on the backbone.

16. The fiber of claim 15, wherein the blend of said graft copolymer comprises (a) a graft copolymer of methyl methacrylate on a polypropylene backbone and (b) a graft copolymer of styrene on a polypropylene backbone.

17. A carpet having a face yarn prepared from the fibers of claim 1.

18. A carpet having a face yarn prepared from the fibers of claim 14.

19. A material selected from the group consisting of yarn, woven textile, non-woven textile and geotextile prepared from the fibers of claim 1.

20. A material selected from the group consisting of yarn, woven textile, non-woven textile and geotextile prepared from the fibers of claim 14.

* * * * *